US012692568B2

(12) United States Patent
Bremensdorfer et al.

(10) Patent No.: US 12,692,568 B2
(45) Date of Patent: Jul. 28, 2026

(54) THERMAL PROCESSING OF CLOSED SHAPE WORKPIECES

(71) Applicants: Mattson Technology, Inc., Fremont, CA (US); Beijing E-Town Semiconductor Technology Co., Ltd., Beijing (CN)

(72) Inventors: Rolf Bremensdorfer, Bibertal (DE); Johannes Keppler, Dornstadt (DE); Michael Yang, Palo Alto, CA (US)

(73) Assignees: Beijing E-Town Semiconductor Technology Co., Ltd., Beijng (CN); Mattson Technology, Inc., Fremont, CA (US)

( * ) Notice: Subject to any disclaimer, the term of this patent is extended or adjusted under 35 U.S.C. 154(b) by 1159 days.

(21) Appl. No.: 17/541,425

(22) Filed: Dec. 3, 2021

(65) Prior Publication Data

US 2022/0090221 A1 Mar. 24, 2022

Related U.S. Application Data

(63) Continuation of application No. 16/059,148, filed on Aug. 9, 2018, now Pat. No. 11,193,178.
(Continued)

(51) Int. Cl.
*C21D 9/08* (2006.01)
*C21D 1/09* (2006.01)
(Continued)

(52) U.S. Cl.
CPC ..... *C21D 9/08* (2013.01); *C21D 1/09* (2013.01); *C21D 9/0062* (2013.01); *C21D 11/00* (2013.01); *C21D 1/34* (2013.01)

(58) Field of Classification Search
CPC ..... C21D 9/08; C21D 1/09; C21D 9/0062; C21D 11/00; C21D 1/34
See application file for complete search history.

(56) References Cited

U.S. PATENT DOCUMENTS 4,803,037 A * 2/1989 McBain ..... C21D 1/64 266/259
4,975,128 A 12/1990 Schmitz
(Continued)

FOREIGN PATENT DOCUMENTS

DE 10 2012 209 079 9/2013
EP 0511274 7/1994

OTHER PUBLICATIONS

PCT International Search Report and Written Opinion for corresponding PCT Application No. PCT/US2018/045941, mailed on Nov. 27, 2018, 16 pages.

*Primary Examiner* — Steven W Crabb
*Assistant Examiner* — Fahmida Ferdousi
(74) *Attorney, Agent, or Firm* — Dority & Manning, P.A.

(57) ABSTRACT

Systems and methods for heat treating closed shape workpieces are provided. In one example implementation, a method can include imparting relative motion of the closed shape workpiece such that the perimeter surface of the closed shape workpiece is moved relative to the lamp heat source from a first position where a first portion of the closed shape workpiece is presented to the lamp heat source to a second position where a second portion of the closed shape workpiece is presented to the lamp heat source. The method can include emitting lamp heat onto the perimeter surface of the closed shape workpiece from the lamp heat source during imparting of relative motion of the closed shape workpiece. The method can include implementing a flux
(Continued)

control procedure during emitting of lamp heat onto the perimeter surface of the closed shape workpiece.

8 Claims, 8 Drawing Sheets

Related U.S. Application Data

(60) Provisional application No. 62/546,269, filed on Aug. 16, 2017.

(51) Int. Cl.

| | |
|---|---|
| ***C21D 1/34*** | (2006.01) |
| ***C21D 9/00*** | (2006.01) |
| ***C21D 11/00*** | (2006.01) |

(56) References Cited

U.S. PATENT DOCUMENTS

| | | | |
|---|---|---|---|
| 6,251,328 | B1 | 6/2001 | Beyer et al. |
| 6,559,424 | B2 | 5/2003 | O'Carroll et al. |
| 6,594,446 | B2 | 7/2003 | Camm et al. |
| 6,849,831 | B2 | 2/2005 | Timans et al. |
| 6,941,063 | B2 | 9/2005 | Camm et al. |
| 6,963,692 | B2 | 11/2005 | Camm et al. |
| 7,398,014 | B1 | 7/2008 | Camm et al. |
| 7,445,382 | B2 | 11/2008 | Camm et al. |
| 7,501,607 | B2 | 3/2009 | Camm et al. |
| 7,654,596 | B2 | 2/2010 | Mantz |
| 7,745,762 | B2 | 6/2010 | Timans |
| 7,781,947 | B2 | 8/2010 | Camm et al. |
| 8,005,351 | B2 | 8/2011 | Camm et al. |
| 8,109,549 | B2 | 2/2012 | Mantz |
| 8,293,035 | B2 | 10/2012 | Zurecki et al. |
| 8,384,274 | B2 | 2/2013 | Camm et al. |
| 8,434,341 | B2 | 5/2013 | Camm et al. |
| 8,454,356 | B2 | 6/2013 | Camm et al. |
| 8,622,451 | B2 | 1/2014 | Mantz |
| 8,693,857 | B2 | 4/2014 | Camm et al. |
| 9,627,244 | B2 | 4/2017 | Camm et al. |
| 10,422,018 | B2 | 9/2019 | Sedlmayr |
| 2001/0036706 | A1 | 11/2001 | Kitamura |
| 2005/0063453 | A1* | 3/2005 | Camm ..... H01L 21/67276 374/161 |
| 2005/0191044 | A1 | 9/2005 | Aderhold et al. |
| 2006/0228465 | A1 | 10/2006 | Zurecki |
| 2009/0302012 | A1* | 12/2009 | Ota ..... C21D 9/08 219/121.64 |
| 2016/0151178 | A1* | 6/2016 | Sedlmayr ..... B23K 15/0086 219/121.16 |

* cited by examiner

THERMAL PROCESSING OF CLOSED SHAPE WORKPIECES

PRIORITY CLAIM

The present application is based on and claims priority to U.S. Provisional Application No. 62/546,269, entitled "Thermal Processing of Closed Shape Workpieces," having a filing date of Aug. 16, 2017, and U.S. Non-Provisional application Ser. No. 16/059,148 having a filing date of Aug. 9, 2018 both which are incorporated by reference herein.

FIELD

The present disclosure relates generally to apparatus, systems, and methods for thermal processing of closed shape workpieces, such as cylindrical workpieces.

BACKGROUND

Thermal processing tools can be used for the heat treatment of workpieces. Thermal processing of cylindrical workpieces (e.g., metal pipes) can be performed, for instance, for cladding, coating, and annealing applications. Thermal processing tools used for the heat treatment of cylindrical workpieces can be performed, for instance, using a laser or other coherent light source with spot sizes of, for instance, about 4 mm by about 6 mm.

SUMMARY

Aspects and advantages of embodiments of the present disclosure will be set forth in part in the following description, or may be learned from the description, or may be learned through practice of the embodiments.

One example aspect of the present disclosure is directed to a method for heat treating a closed shape workpiece. The method can include imparting relative motion of the closed shape workpiece such that the perimeter surface of the closed shape workpiece is moved relative to the lamp heat source from a first position where a first portion of the closed shape workpiece is presented to the lamp heat source to a second position where a second portion of the closed shape workpiece is presented to the lamp heat source. The method can include emitting lamp heat onto the perimeter surface of the closed shape workpiece from the lamp heat source during imparting of relative motion of the closed shape workpiece. The method can include implementing a flux control procedure during emitting of lamp heat onto the perimeter surface of the closed shape workpiece.

Other examples aspects of the present disclosure are directed to apparatus, electronic devices, non-transitory computer-readable media, systems, methods, and processes for heat treating closed shape workpieces, such as cylindrical workpieces.

These and other features, aspects and advantages of various embodiments will become better understood with reference to the following description and appended claims. The accompanying drawings, which are incorporated in and constitute a part of this specification, illustrate embodiments of the present disclosure and, together with the description, serve to explain the related principles.

BRIEF DESCRIPTION OF THE DRAWINGS

Detailed discussion of embodiments directed to one of ordinary skill in the art are set forth in the specification, which makes reference to the appended figures, in which.

DETAILED DESCRIPTION

Figure 1:
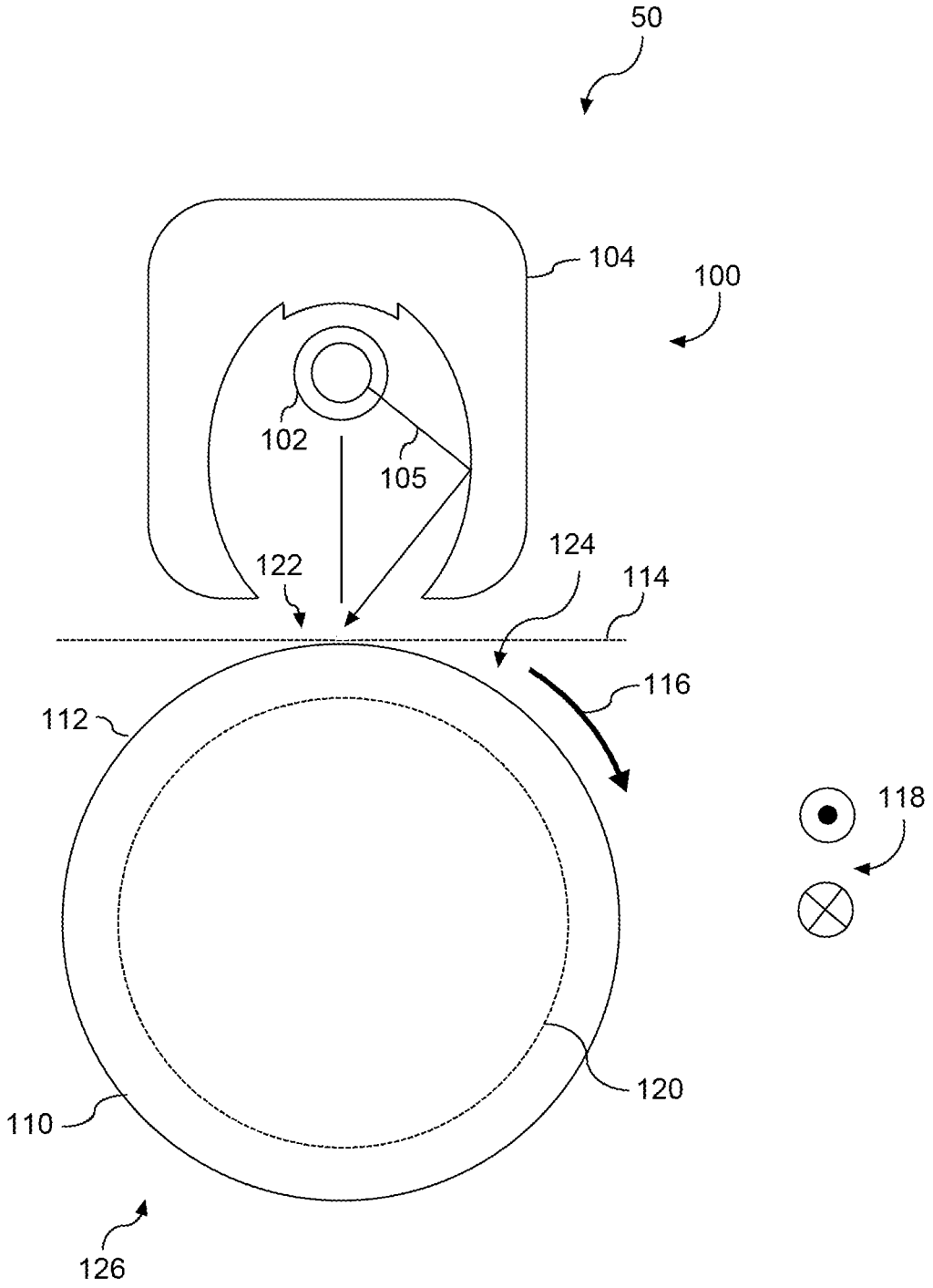
FIG. 1 depicts an example system for thermal processing of workpieces according to example embodiments of the present disclosure.

Reference now will be made in detail to embodiments, one or more examples of which are illustrated in the drawings. Each example is provided by way of explanation of the embodiments, not limitation of the present disclosure. In fact, it will be apparent to those skilled in the art that various modifications and variations can be made to the embodiments without departing from the scope or spirit of the present disclosure. For instance, features illustrated or described as part of one embodiment can be used with another embodiment to yield a still further embodiment. Thus, it is intended that aspects of the present disclosure cover such modifications and variations.

Example aspects of the present disclosure are directed to thermal processing of closed shape workpieces. A closed shape workpiece is a workpiece that has a closed or nearly closed surface that is presented to a heat source during thermal processing. For instance, a closed shape workpiece can include a workpiece where a first portion of the surface is presented to a heat source for thermal processing at time t1. A second portion of the surface adjacent or near the first portion is presented to the heat source at a time t2 (that is after t1). A substantial portion of the perimeter surface (e.g., at least 90% of the perimeter surface) associated with a cross section of the workpiece is presented to the heat source between time t1 and time t2. In some embodiments, a perimeter of the closed shape workpiece can be nearly closed such that a space exists between the first portion and the second portion. The space can represent 15% or less of a total perimeter associated with the closed shape workpiece. One example closed shape workpiece is a cylindrical workpiece, such as a hollow cylindrical workpiece (e.g., a metal pipe). In some embodiments, a perimeter of a cross-section of the closed shape workpiece can be circular, elliptical, annular, ring shaped, or any closed polygon, closed shape or nearly closed shape.

Example aspects of the present disclosure are discussed with reference to cylindrical workpieces such as metal pipes for purposes of illustration and discussion. Those of ordinary skill in the art, using the disclosures provided herein, will understand that the present teachings are applicable to any closed shape workpiece. In addition, the use of the term "about" in conjunction with a numerical value refers to within 20% of the stated amount.

In example embodiments, the thermal processing of closed shape workpieces can be performed in a manner to reduce overheating of the closed shape workpieces during thermal treatment. According to example aspects of the present disclosure, the thermal treatment of cylindrical workpieces can be accomplished in a thermal processing apparatus using one or more arc lamps. Arc lamps can increase a size of the focused light for treating the cylindrical workpiece. For instance, in some embodiments, arc lamps can provide focused light with a size of about 21 mm×about 300 mm.

Overheating can occur in situations where the thermal treatment is applied using a focused light and the focused light approaches an already heated section of a rotating closed shape workpiece. For instance, after one revolution of the rotating closed shape workpiece, a hot zone generated by the focused light can coincide with a hot zone from a previous revolution of the rotating closed shape workpiece, leading to an increase in surface temperature of the cylindrical workpiece.

Overheating of a closed shape workpiece can be reduced by executing a flux control procedure with a lamp heat source to control the heat flux (e.g., heat per time and/or heat per area) during thermal treatment of the closed shape workpiece. Flux can be represented by the following equation:

$$q = \frac{1}{A}\frac{dQ}{dt} \quad \left[\frac{J}{m^2 \cdot s}\right]$$

1 2

In some embodiments, the flux control procedure can control power (e.g. heat per time) of heat emitted by the arc lamp. For instance, by controlling the electrical current passing through an arc discharge in the arc lamp, the intensity of radiated light and therefor the flux can be controlled.

In some embodiments, the flux control procedure can control a rotational speed of the closed shape workpiece. By controlling the speed at which the workpiece is moving through the focused light, the time a portion of the surface of the workpiece is exposed to the focused light can be controlled.

In particular implementations, the flux control procedures according to example aspects of the present disclosure can be operated in an open loop mode or in a closed loop mode. In a closed loop mode, the flux can be controlled in response to signals from a temperature sensor indicative of a temperature of the workpiece using a control method. In an open loop mode, the flux can be controlled by a prescribed set point. The set point can be determined based on a model used to predict the surface temperature of the workpiece.

One example aspect of the present disclosure is directed to a method for heat treating a closed shape workpiece. The method can include imparting relative motion of the closed shape workpiece such that a perimeter surface of the closed shape workpiece is moved relative to the lamp heat source from a first position where a first portion of the closed shape workpiece is presented to the lamp heat source to a second position where a second portion of the closed shape workpiece is presented to the lamp heat source. The method can include emitting lamp heat onto the perimeter surface of the closed shape workpiece from the lamp heat source during imparting of relative motion of the closed shape workpiece. The method can include implementing a flux control procedure during emitting of lamp heat onto the perimeter surface of the closed shape workpiece, the flux control procedure operable to reduce overheating of the first portion of the perimeter surface of the closed shape workpiece.

In some embodiments, the second portion can be located proximate to the first portion. In addition, a substantial portion of the perimeter surface (e.g., at least 90% of the perimeter surface) is located between the first portion and the second portion.

In some embodiments, imparting relative motion can include rotating the closed shape workpiece relative to the lamp heat source. In some embodiments, imparting relative motion can include moving the lamp heat source relative to the closed shape workpiece.

In some embodiments, the flux control procedure can include controlling a current associated with the lamp heat source. In some embodiments, the flux control procedure can include controlling a rotational speed of the closed shape workpiece relative to the lamp heat source.

In some embodiments, the flux control procedure can be implemented in an open loop mode. In some embodiments, the flux control procedure can be implemented in a closed loop mode. In the closed loop mode, the flux control procedure can include obtaining, by one or more control devices, data associated with a temperature measurement of the perimeter surface of the workpiece. The flux control procedure can include implementing, by the one or more control devices, the flux control procedure based at least in part on the data associated with the temperature measurement.

In some embodiments, the lamp heat source can include an arc lamp. The lamp heat source can include an elliptical reflector operable to focus light emitted from the arc lamp onto the perimeter surface of the closed shape workpiece.

In some embodiments, the closed shape workpiece can be a cylindrical workpiece. The cylindrical workpiece can be a hollow cylindrical workpiece. The cylindrical workpiece can be a metal pipe.

In some embodiments, a solid rod of thermally conductive material is located in the cylindrical workpiece. In some embodiments, a fluid cooled pipe is located in the cylindrical workpiece.

In some embodiments, the method can include providing a cooling gas on an outer surface of the workpiece. In some embodiments, the method can include providing a cooling gas on an inner surface of the workpiece.

Another example aspect of the present disclosure is directed to a system for thermally treating a cylindrical workpiece, the system can include a vessel configured to impart rotational motion for a cylindrical workpiece. The system can include a lamp heat source operable to focus lamp heat onto a portion of a perimeter surface of the cylindrical workpiece. The system can include a control system operable to control the vessel to move a perimeter surface of the cylindrical workpiece relative to the lamp heat source from a first position where a first portion of the perimeter surface of the closed shape workpiece is presented to the lamp heat source to a second position where a second portion of the perimeter surface of the closed shape workpiece is presented to the lamp heat source. The second portion can be located proximate to the first portion. At least 90% of the perimeter surface can be located between the first portion and the second portion;

In some embodiments, the control system can be operable to implement a flux control procedure during emission of lamp heat onto the perimeter surface of the cylindrical workpiece to reduce overheating of the first portion of the cylindrical workpiece. The flux control procedure can include controlling a current associated with the lamp heat source. The flux control procedure can include controlling rotational motion of the cylindrical workpiece.

In some embodiments, lamp heat source can include an arc lamp. In some embodiments, the lamp heat source can include an elliptical reflector.

In some embodiments, the control system can include a temperature sensor configured to obtain data indicative of a temperature of the cylindrical workpiece. The control system can be configured to implement the flux control procedure based at least in part on the data indicative of the temperature of the cylindrical workpiece.

In some embodiments, a solid rod of thermally conductive material can be located in the cylindrical workpiece. In some embodiments, a fluid cooled pipe can be located in the cylindrical workpiece.

In some embodiments, the system can include one or more gas dispensers configured to provide a cooling gas to an outer surface of the workpiece. In some embodiments, the system comprises one or more gas dispensers configured to provide a cooling gas to an inner surface of the workpiece.

With reference now to the FIGS., example embodiments of the present disclosure will now be set forth. FIG. 1 depicts an example system 50 for thermal processing of a cylindrical workpiece, such as an outer surface (e.g., perimeter surface) of a steel pipe. The system 50 includes a lamp heat source 100 and a vessel 120. The vessel 120 can be configured to impart rotational movement and/or axial movement of a workpiece 110 (e.g., a cylindrical workpiece such as a steel pipe) relative to the lamp heat source 100. The lamp heat source 100 can emit light 105 onto a perimeter surface 112 of the workpiece 110 to thermally treat the perimeter surface 112 of the workpiece 110 (e.g., for cladding, coating, and/or annealing applications).

More particularly, a lamp heat source 100 can include an arc lamp 102. The arc lamp 102 can be, for instance, an arc lamp where pressurized Argon gas (or other suitable gas) is converted into a high pressure plasma during an arc electrical discharge. In some embodiments, the arc discharge can take place between a negatively charged cathode and a spaced apart positively charged anode (e.g., spaced about 300 mm apart). As soon as the voltage between the cathode and the anode reaches a breakdown voltage of Argon (e.g., about 30 kV) or other suitable gas, a stable, low inductive plasma is formed which emits light in the visible and UV range of the electromagnetic spectrum. The emission of light 105 from the arc lamp can be controlled by controlling a discharge current through the arc lamp 102.

In some embodiments, the plasma is contained within a quartz tube which is water cooled from the inside by a water wall. The water wall can be injected at high flow rates on the cathode end of the lamp and exhausted at the anode end, or vice versa. The same is true for the Argon gas or other gas, which can enter at the cathode end and exhausted from the anode end, or vice versa. The water forming the water wall can be injected perpendicular to the lamp axis such that the centrifugal action generates a water vortex. Hence, along the center line of the lamp a channel is formed for the Argon gas or other gas. The gas column can rotate in the same direction as the water wall. Once plasma has formed, the water wall can protect the quartz tube and confining the plasma to the center axis. Other suitable arc lamps can be used without deviating from the scope of the present disclosure.

Referring to FIG. 1, the lamp heat source 100 can include an elliptical reflector 104. The light 105 emitted from the arc lamp 102 can be reflected from the elliptical reflector 104 onto a perimeter surface 112 a workpiece 110. In some embodiments, the perimeter surface 112 can be positioned at a focal plane 114 associated with the elliptical reflector 104. In some embodiments, the arc lamp 102 can be located at a focal point associated with the elliptical reflector 104. In particular implementations, the light 105 emitted from the arc lamp 102 can be used to treat an about a 21 mm×about 300 mm window on the perimeter surface 112 of the workpiece 110.

During thermal processing, the workpiece 110 can be received onto a vessel 120. The vessel 120 can be configured to impart rotational motion 116 and axial motion 118 (in a direction into and out of the page in FIG. 1) of the workpiece 110 relative to the lamp heat source 100.

For instance, at a time t1 the workpiece 110 can be in a first position where a first portion 122 of the perimeter surface 112 of the workpiece is presented to the lamp heat source 100. At a time t2 which is later than t1, the workpiece 110 can be rotated to a second position where a second portion 124 of the perimeter surface 112 of the workpiece 110 is presented to the lamp heat source 100. Second portion 124 can be proximate or adjacent to the first portion 122 of the perimeter surface 112. Between time t1 and time t2, substantially all of the remainder (e.g., at least 90%) of the perimeter surface 112 (e.g., including portion 126) of the workpiece 110 can be presented to the lamp heat source 100 as the workpiece 110 is rotated relative to the lamp heat source 110.

Aspects of the present disclosure are discussed with reference to rotating the workpiece 110 relative to the lamp heat source 100. In some embodiments, the lamp heat source 100 can be moved relative to a stationary or near stationary workpiece 110.

Figure 2:
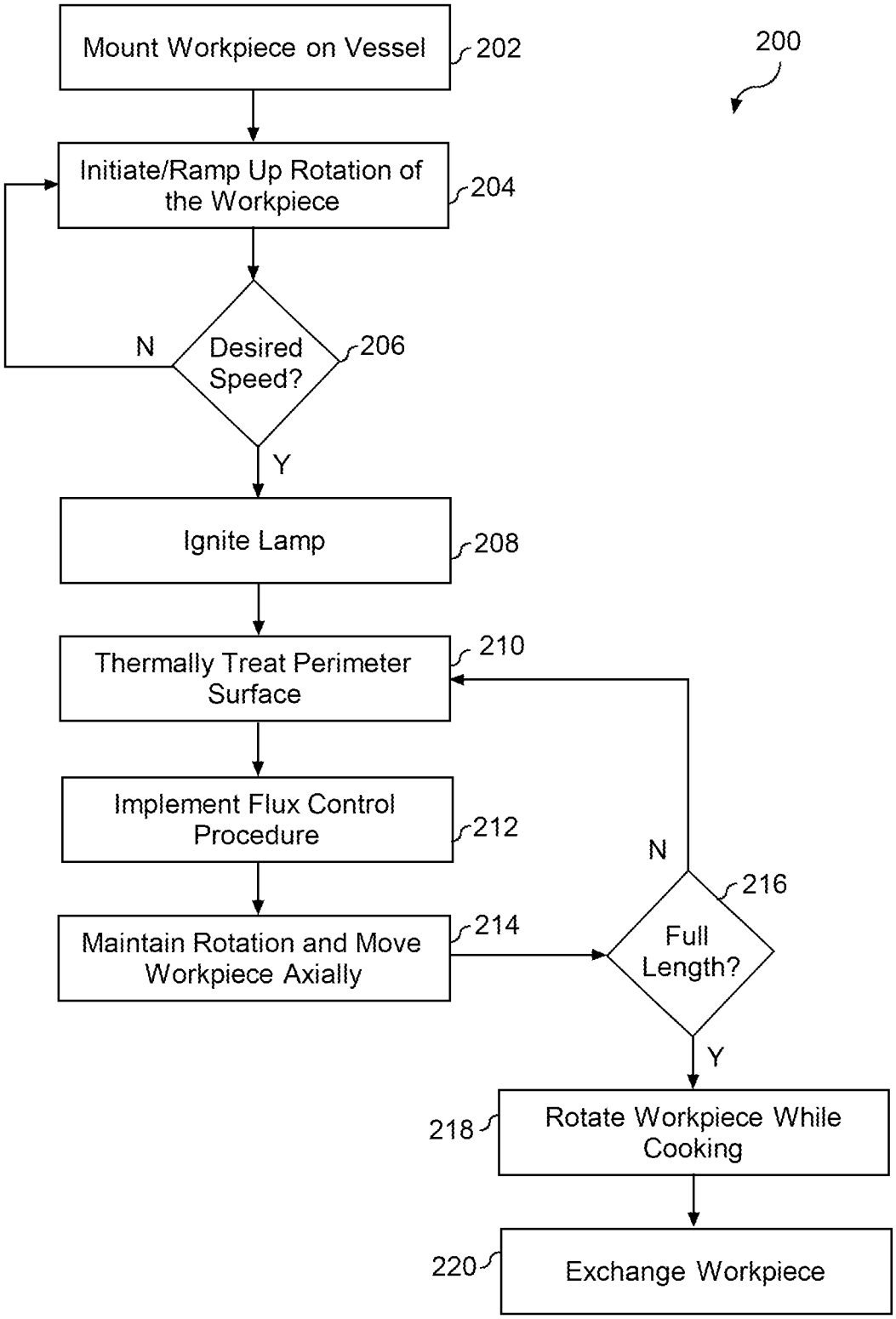
FIG. 2 depicts a flow diagram of an example method for thermal processing of workpieces according to example embodiments of the present disclosure.

FIG. 2 depicts a flow diagram of an example method (200) for thermally treating a workpiece according to example embodiments of the present disclosure. The method (200) can be implemented, for instance, using the system 50 depicted in FIG. 1. FIG. 2 depicts steps performed in a particular order for purposes of illustration and discussion. Those of ordinary skill in the art, using the disclosures provided herein, will understand that various steps of any of the methods disclosed herein can be omitted, rearranged, expanded, performed simultaneously, and/or modified in various ways without deviating from the scope of the present disclosure.

At (202), the method can include mounting the workpiece. For instance, the cylindrical workpiece 110 can be mounted on vessel 120. At (204), the method can include initiating rotation of the workpiece. For instance, the vessel 120 can be controlled (e.g., via one or more signals from controller(s)) to initiate rotation of the workpiece 110 relative to lamp heat source 100. At (206), the method can include determining whether a desired rotational speed of the workpiece is achieved. If not, the method can continue to ramp up rotation of the workpiece until the desired rotational speed is achieved.

Once the desired rotational speed is achieve, the method can proceed to (208) where the lamp heat source is ignited. For instance, the arc lamp 102 can be ignited to emit light onto a perimeter surface of the workpiece 110. At (210), the method can include thermally treating the perimeter surface of the workpiece as the workpiece is rotated relative to the lamp heat source.

According to example embodiments of the present disclosure, a flux control procedure can be implemented at (212) during thermal treatment to improve uniformity of heat treatment of the workpiece. Details concerning example flux control procedures will be discussed in detail below.

At (214), once a full revolution of the workpiece has been treated, the method can include moving the workpiece axially (e.g., in some embodiments while maintaining rotation of the workpiece). For instance, the vessel 120 can be controlled to move the workpiece 110 axially relative to the lamp heat source 100. As shown at (216), thermally treating the perimeter surface (210), implementing the flux control procedure (212), and moving the workpiece axially (214) can be repeated until the full length of the workpiece has been thermally treated.

Once the full length of the workpiece has been thermally treated, the method can include rotating the workpiece while the workpiece cools (218). A new workpiece can be exchanged for thermal processing at (220).

Figure 3:
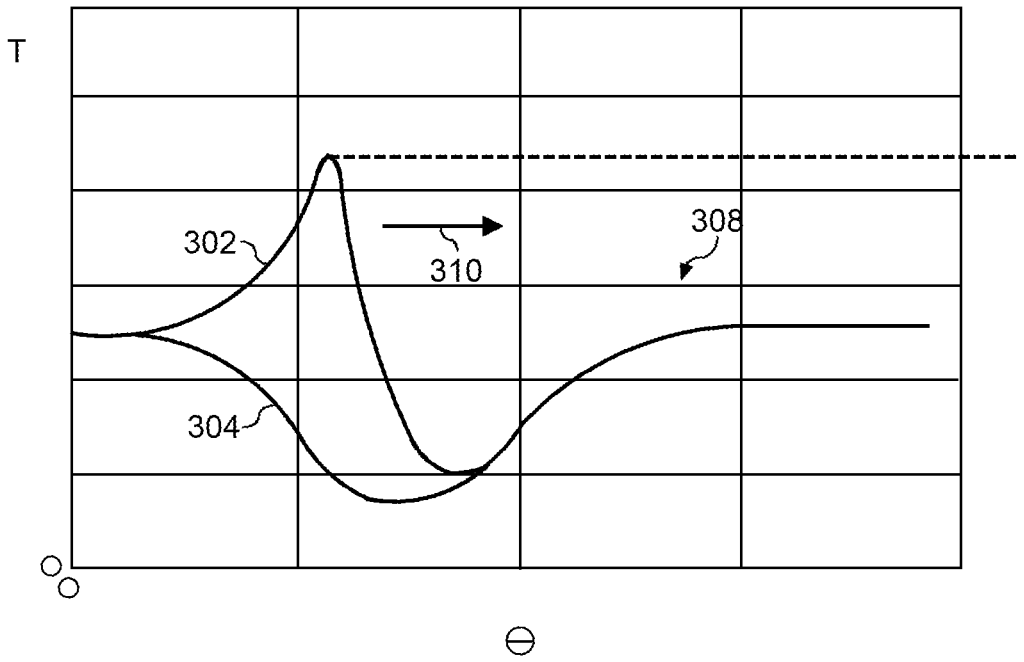
FIG. 3 depicts a graphical representation of a thermal profile of a cylindrical workpiece.

FIG. 3 depicts a graphical representation of a thermal profile of a cylindrical workpiece as it is being thermally treated at a time midway through one revolution of the workpiece. FIG. 3 plots azimuthal position of the workpiece along the horizontal axis and temperature of the workpiece along the vertical axis. Curve 302 represents the surface temperature of the outer perimeter surface of the workpiece. Curve 304 represents the surface temperature of the inner surface of the workpiece. Arrow 310 represents the light from the lamp heat source moving along the perimeter surface of the workpiece as the workpiece is rotated relative to the lamp heat source. Portion 308 of curves 302 and 304 illustrate where a portion of the workpiece is still hot from when thermal treatment started on the workpiece.

Figure 4:
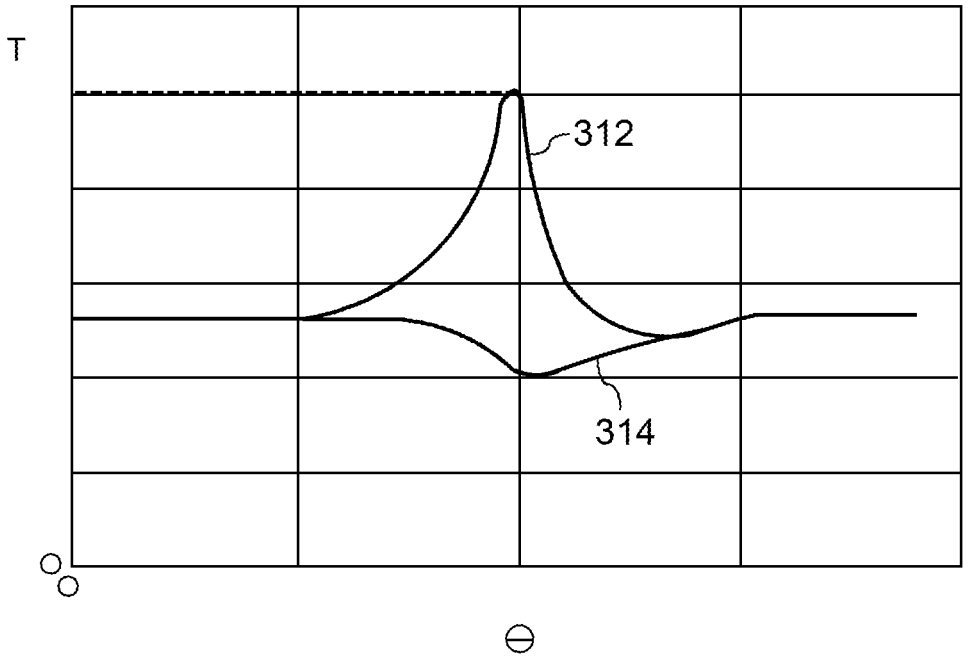
FIG. 4 depicts a graphical representation of a thermal profile of a cylindrical workpiece.

FIG. 4 depicts a graphical representation of a thermal profile of a cylindrical workpiece as it is being thermally treated at a time when one revolution is completed and the light from the lamp heat source has returned to where it started during thermal treatment of the workpiece. FIG. 4 plots azimuthal position of the workpiece along the horizontal axis and temperature of the workpiece along the vertical axis. Curve 312 represents the surface temperature of the outer perimeter surface of the workpiece. Curve 314 represents the surface temperature of the inner surface of the workpiece. As demonstrated, the outer surface of the workpiece can become overheated when the light from the lamp heat source has returned to where it started during thermal treatment of the workpiece.

Figure 5:
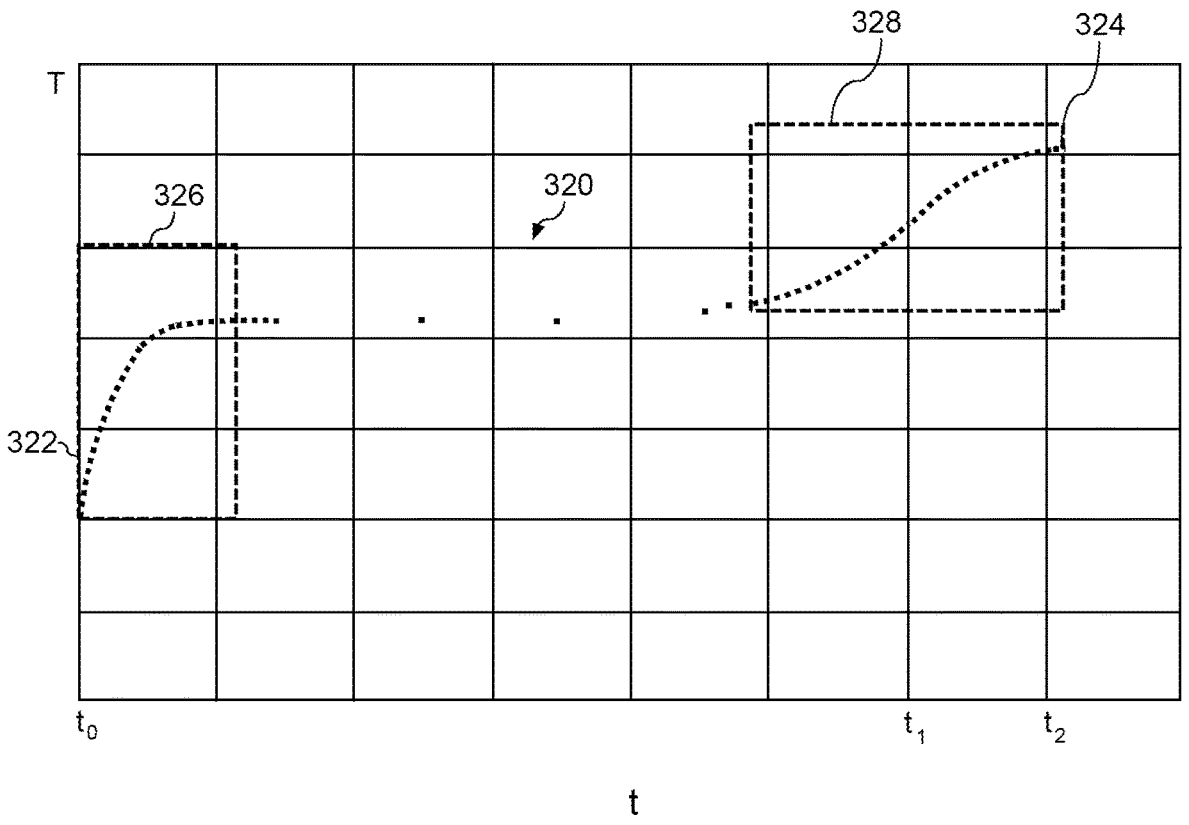
FIG. 5 depicts a graphical representation of a thermal profile of a portion of a surface of a cylindrical workpiece over time.

FIG. 5 depicts a graphical representation of a thermal profile of a portion of a surface of a cylindrical workpiece over time when operating at constant flux from the lamp heat source. FIG. 5 plots time along the horizontal axis and temperature along the vertical axis. At point 322, the time is t0 and the lamp heat source is turned on. At point 324, the time is t2 and the lamp heat source is turned off. A first range covers the time from t0 to t1 and represents one revolution of the workpiece. A second range covers the time from t1 to t2 and represents a time that a portion of the cylindrical workpiece is exposed to the focused light for a second time, or overlap time. As shown in area 326, the portion of the cylindrical workpiece that is heated when the arc lamp is initially turned on is not as hot. However, area 328 demonstrates that portions of the cylindrical workpiece can become overheated.

To reduce overheating of the workpiece, the thermal treatment of a cylindrical workpiece can include implementing a flux control procedure according to example embodiments of the present disclosure. In one example embodiment, the flux control procedure can include controlling the amount of light emitted from the lamp heat source as the workpiece is being thermally treated. For instance, a current associated with the lamp heat source (e.g., a discharge current for the arc lamp) can be controlled to control the amount of light emitted by the lamp heat source. In one example, the current associated with the lamp heat source can be reduced as the portion of the workpiece that has already been thermally treated approaches the light emitted from the lamp heat source to reduce the amount of light emitted onto the portion of the workpiece.

In another example embodiment, the flux control procedure can control movement of the workpiece relative to the lamp heat source to reduce overheating of a portion of the workpiece that has already been thermally treated. For instance, a rotational speed of the workpiece can be increased as the portion of the workpiece that has already been thermally treated approaches the light emitted from the lamp heat source.

The flux control procedure can be implemented in a closed loop or open loop mode. As discussed above, in an open loop mode, the flux can be controlled by a prescribed set point. The set point can be determined based on a model used to predict the surface temperature of the workpiece. In a closed loop mode, the flux can be controlled in response to signals from a temperature sensor indicative of a temperature of the workpiece using a control method.

Figure 6:
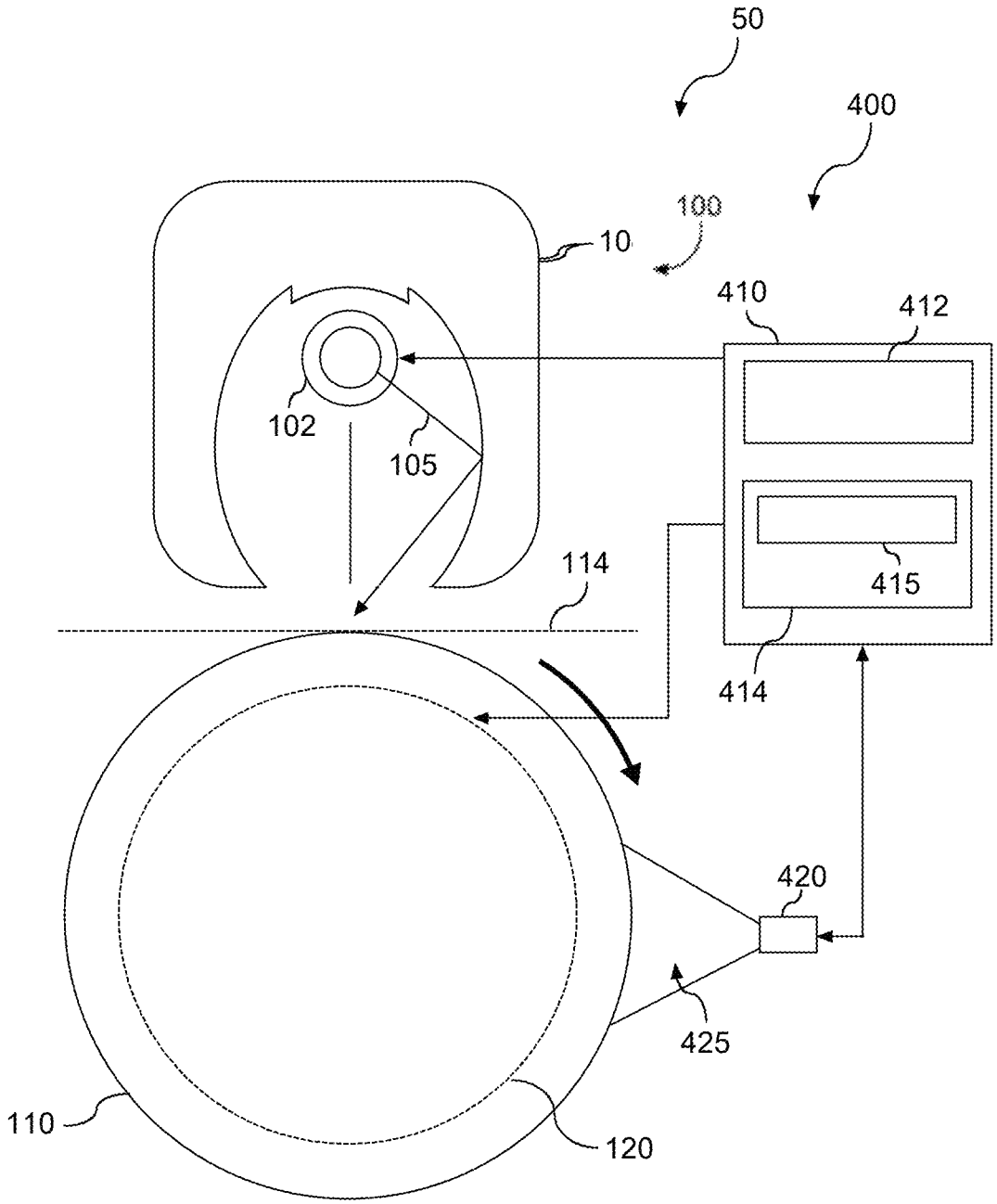
FIG. 6 depicts an example system for thermal processing of workpieces according to example embodiments of the present disclosure.

FIG. 6 depicts an example system 50 for thermally treating a workpiece 110 that include a control system 400 for implementing a flux control procedure in a closed loop mode according to example aspects of the present disclosure. The control system 400 can include one or more controllers 410. Controller(s) 410 can be any suitable control device for implementing control actions (e.g., controlling vessel 120 and/or controlling arc lamp 102).

In some embodiments, controller(s) 410 can include one or more processors 412 and one or more memory devices 414. The one or more processors 412 can be any suitable processing device (e.g., a processor core, a microprocessor, an ASIC, a FPGA, a controller, a microcontroller, etc.) and can be one processor or a plurality of processors that are operatively connected. The memory devices 414 can include one or more non-transitory computer-readable storage media, such as RAM, ROM, EEPROM, EPROM, one or more memory devices, flash memory devices, etc., and combinations thereof.

The memory devices 414 can store computer-readable instructions that when executed by the one or more processors cause the controller(s) 410 to perform operations. The operations can include any operations disclosed herein, such as operations for implementing a flux control procedure in a closed loop mode. The memory devices 414 can also include data. The data can include, for instance, a model 415. The model 415 can be a predictive model for behavior and/or desired behavior of a surface temperature of the workpiece during thermal processing.

The control system 400 can include a temperature sensor 420. The temperature sensor 420 can be configured to measure a temperature of a surface of the workpiece 110 during thermal processing. The temperature sensor 420 can be a thermal radiometer or other temperature sensor.

The temperature sensor 420 can be associated with a field of view 425. The temperature sensor 420 can be positioned to measure the surface temperature of a portion of the cylindrical workpiece 110 within the field of view 425. In some embodiments, the temperature sensor 420 can be positioned such that the field of view 425 does not include the light 105 from the lamp heat source 100 so that the light 105 does not impact temperature measurements by the sensor 420. In some embodiments, the temperature sensor 420 is positioned such the field of view 425 is directed to a portion of the workpiece 110 after it has rotated through the light 105, such as a portion of the surface of the workpiece about 90° in the azimuthal direction after rotating through the light 105.

In some embodiments, the temperature sensor 420 can be arranged such that the field of view 425 is directed to a portion of the workpiece 110 right before it rotates through the light 105, such as directed to a portion of the surface of the workpiece 110 about 90° in the azimuthal direction prior to rotating through the light 105.

Measurements from the temperature sensor 420 can be processed by controller(s) 410 and used to execute control actions to implement a flux control procedure. For instance, the measurements can be compared with expected measurements determined using a model. When the measurements from the temperature sensor 420 differ by a threshold, then the controller(s) 410 can be engaged to implement a flux control procedure according to example embodiments of the present disclosure to alter the flux. For instance, the controller(s) 410 can send one or more signals to control the vessel 120 to adjust a rotational speed of the workpiece. The controller(s) 410 can send one or more signals to control a discharge current of arc lamp 102. The controller(s) 410 can execute other suitable control actions without deviating from the scope of the present disclosure.

In some embodiments, because a cylindrical workpiece is hollow, an inner surface of the cylindrical workpiece cannot cool off by radiation, as radiation is absorbed by an opposite side. This problem can be especially true for pipes with thin walls. This problem can prevent a thermal gradient across wall thickness of the cylindrical workpiece from being maintained and the entire workpiece can overheat. In some embodiments, this problem can be addressed by causing air and/or another suitable gas to pass through the cylindrical workpiece as a means for cooling the inner surface (i.e., forced convection). Other embodiments for cooling an inner surface of a workpiece are discussed with reference to FIGS. 7, 8 and 9 below.

Figure 7:
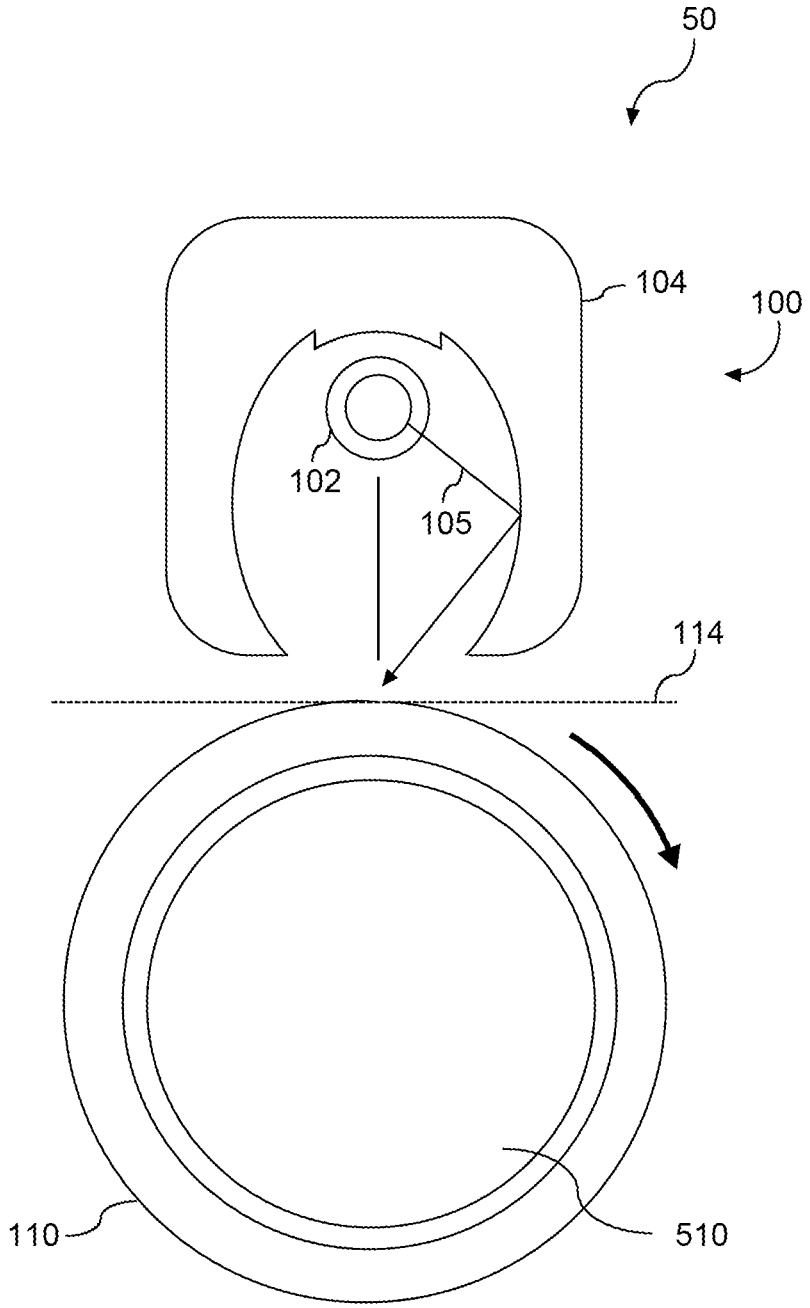
FIG. 7 depicts an example system for thermal processing of workpieces according to example embodiments of the present disclosure.

FIG. 7 depicts a system 50 for thermally treating a workpiece according to example embodiments of the present disclosure. The system 50 is similar to that of FIGS. 1 and 6. A solid rod 510 of thermal conductive material is located inside the cylindrical workpiece 110. The solid rod 510 can act as a heat sink for heat leaving the inner surface of the cylindrical workpiece 110. In an example aspect, the solid rod 510 can act as a baffle, preventing reabsorption of thermal radiation by the cylindrical workpiece 110.

Figure 8:
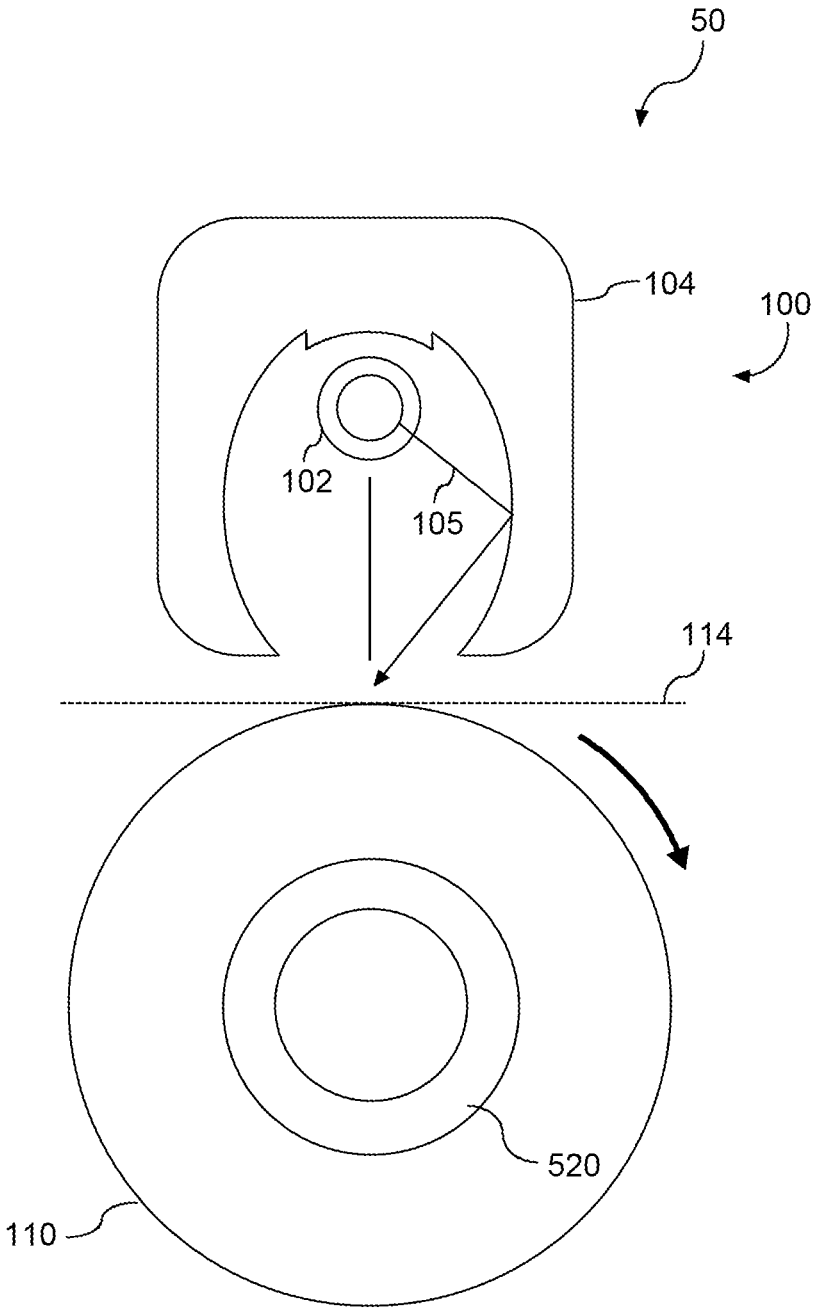
FIG. 8 depicts an example system for thermal processing of workpieces according to example embodiments of the present disclosure.

FIG. 8 depicts a system 50 for thermally treating a workpiece according to example embodiments of the present disclosure. The system 50 is similar to that of FIGS. 1 and 6. A fluid cooled pipe 520 (e.g., water cooled) can be located inside the cylindrical workpiece 602. The fluid cooled pipe 520 can include water or other fluid flowing through the pipe 520. The fluid cooled pipe 520 and/or the fluid can act as a heat sink for heat leaving the inner surface of the cylindrical workpiece 110. In an example aspect, the fluid cooled pipe 520 and/or the fluid can act as a baffle, preventing reabsorption of thermal radiation by the cylindrical workpiece 110.

Figure 9:
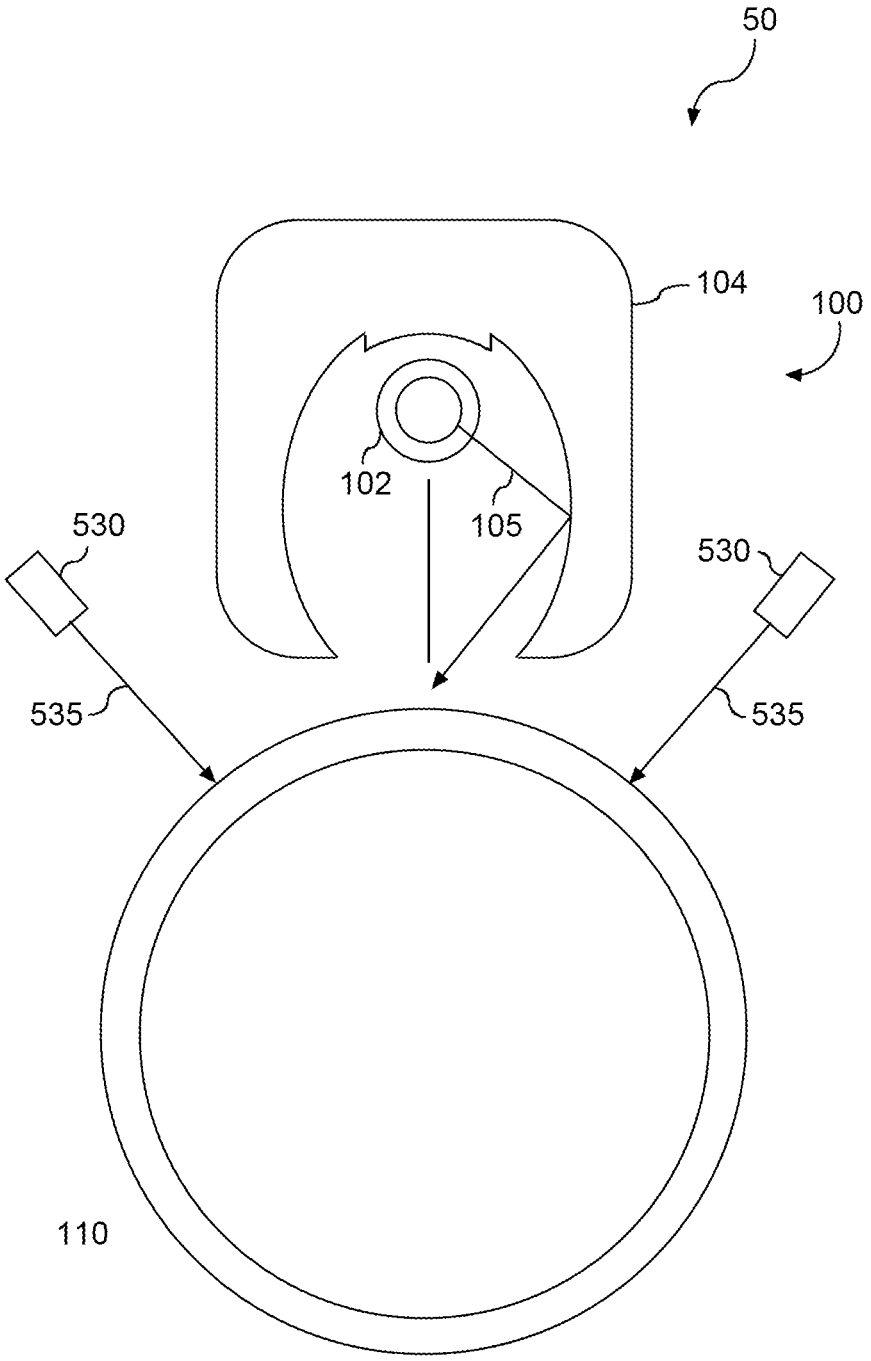
FIG. 9 depicts an example system for thermal processing of workpieces according to example embodiments of the present disclosure.

FIG. 9 depicts a system 50 for thermally treating a workpiece according to example embodiments of the present disclosure. The system 50 is similar to that of FIGS. 1 and 6. The system includes one or more gas dispensers 530. The one or more gas dispensers 530 can provide a suitable cooling gas 530 or other fluid to an outer surface of the cylindrical workpiece 110. The one or more gas dispensers 530 can be configured to dispense gas or other fluid at any portion of the outer surface of the workpiece 110. Two gas dispensers 530 are illustrated in FIG. 9. However, those of ordinary skill in the art, using the disclosures provided herein, will understand that more or fewer gas dispensers can be used without deviating from the scope of the present disclosure.

While the present subject matter has been described in detail with respect to specific example embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. A system for thermally treating a cylindrical workpiece, the system comprising:

a vessel configured to impart rotational motion for the cylindrical workpiece;

a lamp heat source operable to focus lamp heat onto a portion of a perimeter surface of the cylindrical workpiece;

a control system operable to:

control the vessel to initiate and ramp up the rotational motion of the cylindrical workpiece to a desired rotational speed;

ignite the lamp heat source after the desired rotational speed is achieved; and control the vessel to move the perimeter surface of the cylindrical workpiece relative to the lamp heat source from a first position where a first portion of a perimeter surface of a the closed shape cylindrical workpiece is presented to the lamp heat source to a second position where a second portion of the perimeter surface of the closed shape cylindrical workpiece is presented to the lamp heat source, the second portion being located proximate to the first portion, at least 90% of the perimeter surface of the closed shape cylindrical workpiece being located between the first portion and the second portion, wherein the control system comprises a temperature sensor configured to measure a temperature of the perimeter surface of the cylindrical workpiece, the temperature sensor comprises a thermal radiometer positioned such that a field of view associated with the temperature sensor is directed to a portion of the cylindrical workpiece after it has rotated through light from the lamp heat source and such that the field of view does not include light from the lamp heat source.

2. The system of claim 1, wherein the control system is operable to implement a flux control procedure during emission of lamp heat onto the perimeter surface of the cylindrical workpiece to reduce overheating of the first portion of the cylindrical workpiece.

3. The system of claim 1, wherein the control system is configured to implement a flux control procedure based at least in part on data indicative of the temperature of the cylindrical workpiece.

4. The system of claim 1, wherein the system comprises one or more gas dispensers configured to provide a cooling gas to an outer surface of the cylindrical workpiece or one or more gas dispensers configured to provide a cooling gas to an inner surface of the cylindrical workpiece.

5. The system of claim 1, wherein the lamp heat source comprises:

an arc lamp; and an elliptical reflector operable to focus light emitted from the arc lamp onto the perimeter surface of the closed shape cylindrical workpiece.

6. The system of claim 1, wherein the cylindrical workpiece is a metal pipe.

7. The system of claim 1, wherein a solid rod of thermally conductive material is located in the cylindrical workpiece.

8. The system of claim 1, wherein a fluid cooled pipe is located in the cylindrical workpiece.

* * * * *